United States Patent [19]

Miyazaki et al.

[11] 4,401,982

[45] Aug. 30, 1983

[54] FLUORESCENT DISPLAY TUBES AND METHOD OF DRIVING THE SAME

[75] Inventors: Togo Miyazaki; Junichi Suehiro, both of Izumi, Japan

[73] Assignee: Nippon Electric Co., Ltd., Tokyo, Japan

[21] Appl. No.: 259,468

[22] Filed: May 1, 1981

[30] Foreign Application Priority Data

May 6, 1980 [JP] Japan ..... 55-61569

[51] Int. Cl.[3] ..... H01J 63/02

[52] U.S. Cl. ..... 340/758; 340/772

[58] Field of Search ..... 340/753, 754, 758, 759, 340/760, 772, 774, 771; 313/495-496, 497, 513, 517; 315/169.1-169.4

[56] References Cited

U.S. PATENT DOCUMENTS

| | | | |
|---|---|---|---|
| 4,149,105 | 4/1979 | Hirooka | 313/496 |
| 4,164,683 | 8/1979 | Nakamura | 313/513 |
| 4,178,593 | 12/1979 | Kishino | 340/772 |
| 4,194,199 | 3/1980 | Shepherd | 340/754 |
| 4,204,209 | 5/1980 | Suehiro | 340/758 |
| 4,218,636 | 8/1980 | Miyazawa | 313/497 |

*Primary Examiner*—Michael A. Masinick

*Attorney, Agent, or Firm*—Blakely, Sokoloff, Taylor & Zafman

[57] ABSTRACT

In a fluorescent display tube provided with a plurality of electrically isolated grids, spacings for electrically isolating the grids are arranged to divide portions of an anode to be integrally displayed.

8 Claims, 5 Drawing Figures

FLUORESCENT DISPLAY TUBES AND METHOD OF DRIVING THE SAME

BACKGROUND OF THE INVENTION

This invention relates to a fluorescent display tube and a method of driving the same.

Generally, in a fluorescent display tube, electrons emitted by a filament shaped cathode are caused to collide against an anode coated with a phosphor layer for exciting the phosphor layer to emit light thus displaying a character, pattern, digit or the like.

For this reason, in most prior art constructions, a mesh shaped grid is interposed between the cathode and anode for the purpose of accelerating electrons emitted from the cathode. Such display tube is constructed such that the luminous display of the anode can be viewed through the mesh shaped grid.

For this reason, it has been necessary to construct the grid such that it can provide a control function for controlling and accelerating the electrons emitted by the cathode and collided upon the anode and that it would have a thin and fine mesh construction to enable viewing from outside the luminous characters or the like displayed by the anode. Furthermore, an ordinary fluorescent display tube is provided with digits or characters of a plurality of orders of magnitude and for the purpose of imparting an adequate mechanical strength to the grids, a frame of a definite width is provided, and respective grids are spaced from each other enabling a viewer to see the displayed matters through the spacings. However, where the grids are arranged in a manner as above described, that is covering each unit display segment group and not to cover portions between displayed matters, it is necessary to separate adjacent display segment groups a definite distance. Moreover, where grids of complicate shape are divided there are many problems.

Where the grids are spaced in the longitudinal direction of the tube, the presence of laterally long displayed matters makes it more difficult to construct the grids.

To provide a display which perfectly surround a displayed matter is nearly impossible.

SUMMARY OF THE INVENTION

Accordingly, it is an object of this invention to provide a fluorescent display tube and a method of driving the same which can clearly display the displayed matters such as characters, digits and patterns coated with phosphors by using an anode capable of integrally displaying such displayed matters.

Another object of this invention is to provide a novel fluorescent display tube and a method of driving the same which can design at a higher freedom than the prior art display tube for displaying a complicated pattern such as characters, digits, and picture.

Still another object of this invention is to provide a fluorescent display tube and a method of driving the same having simpler construction and can be manufactured at a lower cost than the prior art display tube and can display complicated characters, digits and patterns.

According to one aspect of this invention there is provided a fluorescent display tube comprising an anode arranged on a substrate and coated with a phosphor according to a predetermined pattern to be displayed, a plurality of grids disposed above the anode a predetermined distance apart therefrom, the grids being electrically isolated from each other for dividing the phosphor pattern into a plurality of sections, and a cathode disposed above the grids a predetermined distance apart therefrom.

According to another aspect of this invention there is provided a method of driving a fluorescent tube of the type just described, which comprises the steps of simultaneously applying a control signal to respective grids, and driving a selected anode by applying an anode selection signal.

DESCRIPTION OF THE PREFERRED EMBODIMENT

Figure 1:
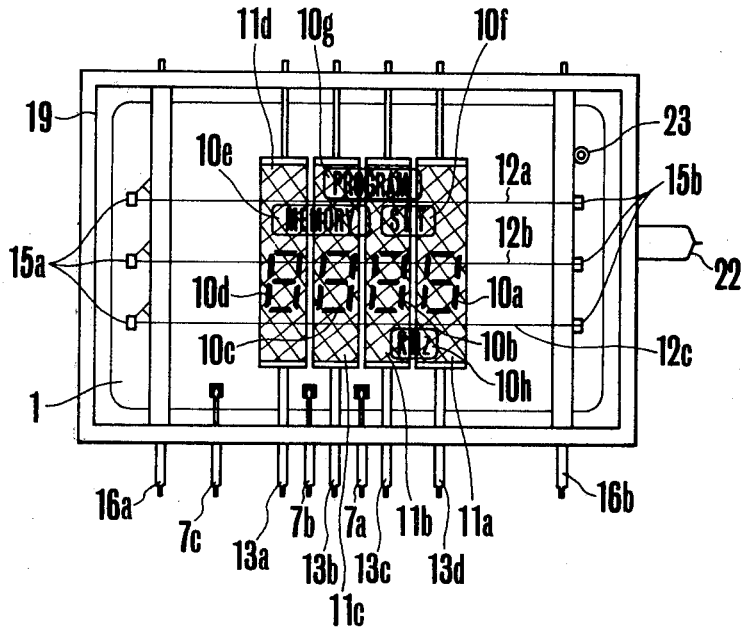
FIG. 1 is a plan view showing one embodiment of a fluorescent display tube according to this invention.
Figure 2:
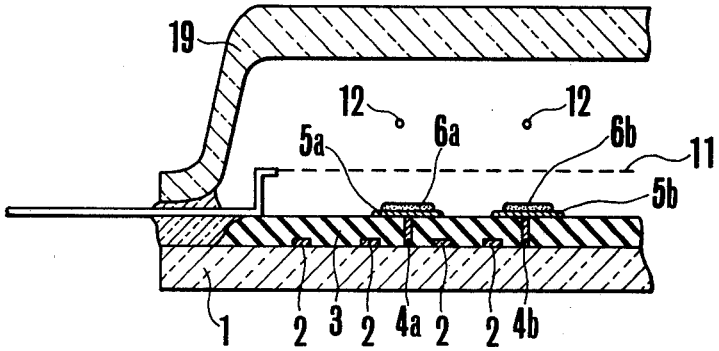
FIG. 2 is a partial sectional view of the display tube shown in FIG. 1.
Figure 3:
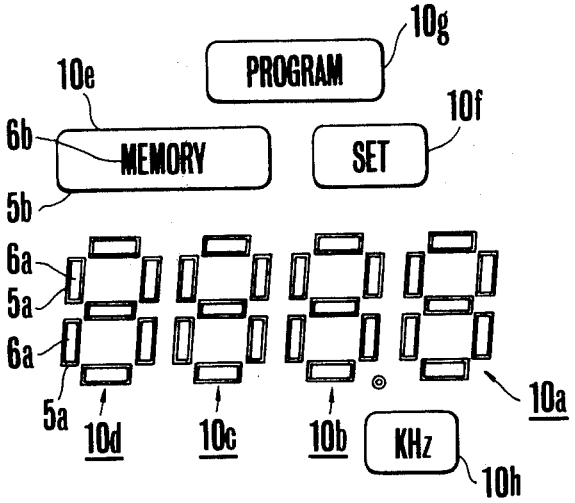
FIG. 3 is a plan view showing the shape and arrangement of the anodes of the display tube shown in FIG. 1.

A preferred embodiment of the fluorescent display tube according to this invention shown in FIGS. 1 to 3 comprises a substrate 1 made of insulating material for example glass or ceramic, and various elements shown in FIG. 2 mounted on the substrate. Wire conductors 2 are applied on the surface of the substrate 1 with screen printing technique, for example. An insulating layer 3 formed with holes 4*a* and 4*b* at predetermined positions is laminated on the wiring conductors. Electrodes 5*a* and 5*b* are formed on the upper surface of the insulating layer 3 and electrically connected to the lower wiring conductors through conductors extending through holes 4*a* and 4*b*. Segment shaped phosphor layers 6*a* and 6*b* are formed on the electrodes 5*a* and 5*b* in a desired pattern. These phosphor layers comprise so-called anodes and the light emitted thereby is viewed from outside as displays. The anodes 6*a* and 6*b* are connected to external terminals shown in FIG. 1 through wiring conductors 2 on the substrate 1.

The pattern of the anodes utilized in the illustrated fluorescent display tube is shown in FIG. 3. Thus, in this example, four letter-8-shaped anodes 10*a*, 10*b*, 10*c* and 10*d* are disposed along a straight line with a definite spacing therebetween. Further, other anodes 10*e*, 10*f*, 10*g* and 10*h* of which three have such specific meanings as "MEMORY", "SET" and "PROGRAM" are disposed above the letter-8-shaped anodes 10*a* through 10*d*, while the last indicative of "KHZ" being disposed below. Each one of the letter-8-shaped anodes is constituted by seven anode segments. However, terms as MEMORY, SET, etc., are formed by coating a phosphor in the form of respective terms on a common conductive electrode such that the term as a whole comprises a single segment.

Turning back to FIG. 2, a grid 11 is disposed above the anodes with a definite spacing therebetween and a filament shaped cathode 12 is disposed above the grid 11 with a definite spacing therebetween.

To dynamically drive these anodes, according to the same consideration as a conventional 4 digit display tube, it is necessary to divide the grid 11 into four sections 11*a*, 11*b*, 11*c* and 11*d* as shown in FIG. 1.

Thus, respective sections of the grid overlie respective letter-8-shaped anodes 10*a* through 10*d*, but for the anodes 10*e* through 10*h* of such terms as MEMORY, SET, etc., the grid is divided such that each section overlies the whole length of each term. The grid is made of a very thin metal sheet and divided into small hexagonal shapes of a small pitch.

Each grid section is provided with a peripheral frame having a width of about 0.05 to 0.1 mm for the purpose of reenforcing, and the grid sections are spaced from each other by about 0.08 to 0.1 mm to provide necessary electric isolation. The anode and grids are spaced about 0.4 mm. With this construction, the grid can be constructed relatively regularly. With the prior art construction, however, in order to prevent interference with the display, the sections of the grid are not disposed above the anodes that contribute to display, but instead the grid is constructed to have complicated configuration so as to dispose the sections of the grid at the spaces between anodes. As shown in FIG. 1, these grid sections 11*a* through 11*d* are connected to lead wires 13*a* through 13*d* which lead to outside.

Uniformly spaced filaments 12*a*, 12*b* and 12*c* are disposed above the grids in the longitudinal direction thereof. These filaments are supported under tension by filament supports 15*a* and 15*b* and are connected to external current source via lead wires 16*a* and 16*b*. A box shaped enclosure 19, at least the front surface being transparent, is hermetically sealed to the periphery of the substrate 1 carrying various electrodes to hold them in vacuum, and the interior of the enclosure 19 is exhausted through an exhaust tube 22. Thereafter, a getter 23 disposed in the enclosure is evaporated to create a high vacuum, thus completing the fluorescent display tube of this invention.

Figure 4:
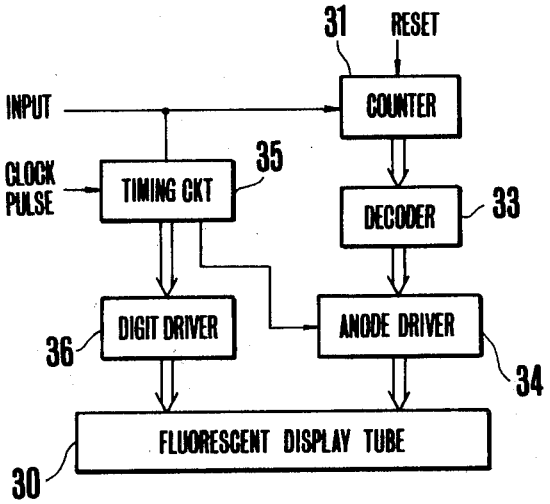
FIG. 4 is a block diagram showing one example of a drive circuit of the fluorescent display tube shown in FIGS. 1 to 3.

FIG. 4 shows one example of a dynamic drive circuit of the fluorescent display tube 30 described above. An input pulse signal for driving the tube 30 is supplied to a counter 31 and a timing circuit 32. The counter 31 counts the number of the input pulse signals sent at a predetermined timing, and the count of the counter is sent parallelly to a decoder 33 to be decoded. The decoder 33 sends its decoded output to an anode driver 34 for determining which one of the anodes should be selected with the output of the counter 31, and which one of the anode segments should be selected where one or more of the letter-8-shaped anodes 10*a* through 10*d* are to be selected. In accordance with the output of the timing circuit 35, the anode driver 34 applies its output to predetermined anodes of the fluorescent display tube 30. The timing circuit 35 is supplied with a clock pulse from a clock pulse generator not shown, for sending a timing pulse to a digit driver 36 and an anode driver 34 for producing a grid selection signal and an anode selection signal to be described later with reference to FIG. 5. At this time, the timing circuit 35 receives a portion of the input supplied to the counter 31 to form a timing pluse sychronous with the input data. A group of the timing pulses is sent to the digit driver 36 to form the grid selection signal. The digit driver 36 applies at a predetermined timing the grid selection signal to corresponding grids. The output of the timing circuit 35 sent to the anode driver 34 is used as the blanking signal.

Figure 5:
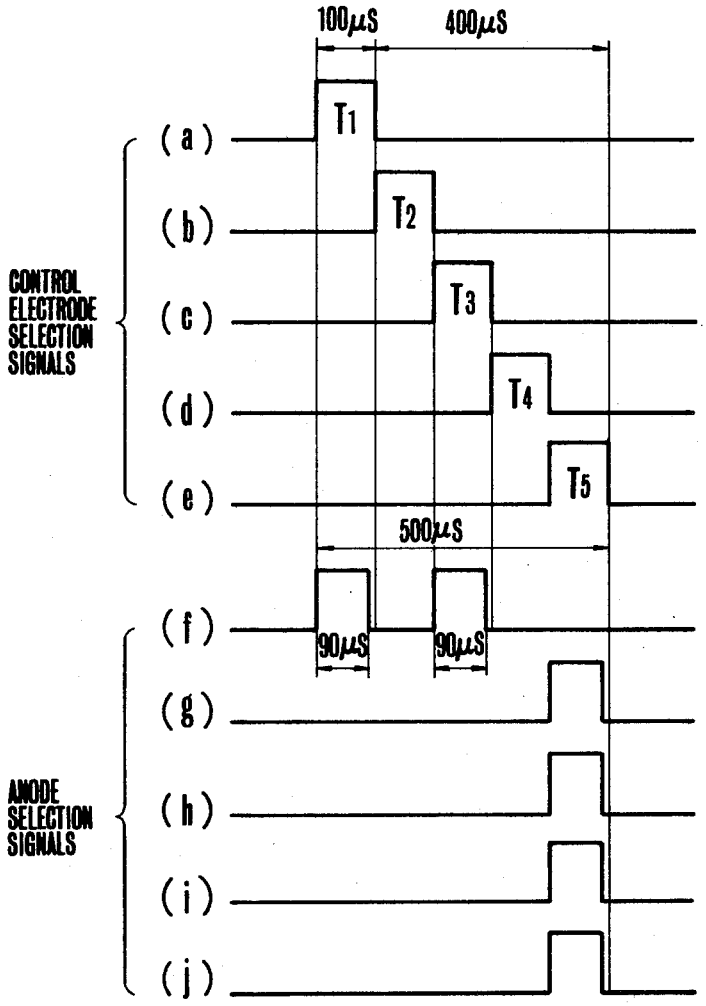
FIGS. 5*a* through 5*e* show waveforms of grid selection signals outputted from the digit driver shown in FIG. 4.
FIGS. 5*f* through 5*j* show waveforms of anode selection signals outputted from the anode driver shown in FIG. 4.

The driving operation of the fluorescent display tube shown in FIGS. 1 through 3 with the drive circuit shown in FIG. 4 will now be described with reference to the waveforms shown in FIG. 5. Waveforms shown by curves a to e in FIG. 5 show grid selection signals (in the form of pulses) formed by the digit driver 36 according to the output of the timing circuit 35 for the purpose of sequentially energizing grids 11*a*, 11*b*, 11*c*, 11*e* and 11*d* with timings of T1–T4, that is with different timings such that signals would not overlap between respective grids. Curve e shown in FIG. 5 shows a pulse formed at the last timing T5 after pulses a through d have been sequentially sent out and corresponds to the grid selection signal utilized to simultaneously energize all grids 11*a* through 11*d*. The width of the pulses shown in FIGS. 5*a* through 5*e* is 100 microseconds, for example, so that the repetition period of the grid selection signal is 500 microseconds. The pulse waveforms shown in FIGS. 5*f* through 5*j* represent anode selection signals formed in accordance with the outputs of the decoder 33 and of the timing circuit 35 and are sent out from the anode driver 34. The waveform shown in FIG. 5*f* is utilized to select the segments of the letter-8-shaped anodes 10*a* through 10*d* of the fluorescent display tube. Of the timings T1–T5 of the grid selection signal, the first four timings T1–T4 are utilized to form segment selection signals of corresponding anodes 10*a* through 10*d*. As a consequence, 7 segments of respective letter-8-shaped digits 0 through 9 are selected by the selection signals sent out from the anode driver 34 whereby the fluorescent display tube 30 selects and displays the digits 0 through 9. The selection signals utilized at this time are formed by the anode driver 34 according to the decoder output and the logic product of these selection signals, but in order to prevent dynamically displayed portions from overlapping each other, in other words in order to prevent so-called cross talk, the width of the anode selection signal pulse is selected to be shorter than 100 microseconds of the grid selection signal, for example to be 90 microseconds.

Since pulse signals are applied to the grids 11*a*–11*d* at the fifth timing, where signals are simultaneously applied to anodes 10*e* through 10*h* according to a combination of the outputs of the decoder and the timing circuit, terms "MEMORY", "SET", "PROGRAM", "KHZ", etc. are driven statically and since adjacent grids are all energized even when their displays bridge some of the grids, the displays can be made extremely clearly without being adversely effected by electric field.

Also since the spacings between divided sections of the grid are very narrow, that is of the order of 0.15–0.2 mm, when viewed from outside the effect of the spacings upon the display is negligibly small.

It should be understood that the width of the divided sections of the grid should be limited to be less than 1 mm. When adjoining grids are all energized, the electric field acting upon the anodes should be uniform.

Although in the foregoing description, the spacing between anode and grids was 0.4 mm, the maximum width of the divided sections should vary depending upon this spacing.

As above described, with the fluorescent tube of this invention, as it is possible to use a grid extending in the longitudinal direction of the displayed matter it is not only possible to freely arrange complicated characters, digits, patterns, pictures, etc., but also regularly construct the grid electrode, with the result that the construction is simplified and the cost of manufacturing can be reduced, thereby providing a novel fluorescent tube that can not be obtained with the prior art design.

It should be understood that the invention is by no means limited to the specific embodiment described above and that various changes and modifications may be made without departing from the spirit of this invention as defined in the accompanying claims.

For example, although in the foregoing embodiment English terms were disposed in the longitudinal direction of a divided control grid, a frame shaped display member encirculating the entire display matter or a decimal point display member disposed in a narrow space between letter 8 type digits can also be used.

What is claimed is:

1. A fluorescent display tube comprising:

an anode arranged on a substrate and coated with phosphor according to a predetermined pattern to be displayed;

a plurality of grids disposed above said anode a predetermined distance apart therefrom, said grids being electrically isolated from each other for dividing said phosphor pattern into a plurality of sections;

means for selectively energizing said grids;

a cathode disposed above said grids a predetermined distance apart therefrom; and whereby said predetermined pattern is displayed according to said selectively energized grids and between adjacent selectively energized grids.

2. The fluorescent display tube according to claim 1 wherein said plurality of grids are arranged in a plane substantially parallel with said substrate and spacings between divided sections of the grids have such small dimensions that they are substantially undetectable when viewed from outside of said tube.

3. The fluorescent tube according to claim 2 wherein said spacings are less than 1 mm.

4. The fluorescent tube according to claim 1 wherein said grids are constituted by a mesh, and a frame surrounding the same.

5. In a fluorescent display tube of the type comprising an anode having a phosphor layer coated thereon, a cathode facing said anode, and a plurality of electrically isolated grids positioned between said anode and said cathode for accelerating and controlling electrons emitted from said cathode toward said anode whereby light emitted by said anode is viewed from the outside of said tube through said grids, the improvement wherein digit dividing means for electrically isolating said plurality of grids are located such that said dividing means divides an integral display portion of said anode into sections to be displayed;

wherein said dividing means is selectively controllable whereby said integral display portion may be viewed from the outside of said tube.

6. A fluorescent display tube comprising:

a plurality of anodes mounted on a substrate and coated with phosphor according to a predetermined pattern to be displayed, said anodes being divided into two groups;

a plurality of electrically isolated grids disposed above said anodes a predetermined distance apart therefrom;

a means for selectively energizing said grids;

a cathode disposed above said grids a predetermined distance apart therefrom;

one of said anode groups being coated with phosphor in the form of a letter 8 and juxtaposed for displaying digits of a plurality of orders of magnitude;

the other one of said anode groups being disposed apart from said one group;

said grids being arranged such that they select orders of magnitude according to the anodes of said one group and that they divide said anodes into sections to be displayed by respective anodes of said second group;

whereby said predetermined pattern is displayed according to said selectively energized grids and between adjacent selectively energized grids.

7. A method of driving a fluorescent display tube of that type comprising an anode arranged on a substrate and coated with phosphor according to a predetermined pattern to be displayed; a plurality of grids disposed above said anode a predetermined distance apart therefrom, said grids being electrically isolated from each other for dividing said phosphor pattern into a plurality of sections, a means for selectively energizing said grids, whereby said predetermined pattern is displayed according to said selectively energized grids and between adjacent selectively energized grids; and a cathode disposed above said grids a predetermined distance spaced therefrom, said method comprising the steps of simultaneously applying a control signal to respective grids, and driving a selected anode by applying an anode selection signal.

8. A method of driving a fluorescent tube of the type comprising a plurality of anode electrodes mounted on a substrate and coated with phosphor according to a predetermined pattern to be displayed, said anodes being divided into two groups; a plurality of electrically isolated grids disposed above the anodes a predetermined distance apart therefrom; a means for selectively energizing said grids, whereby said predetermined pattern is displayed according to said selectively energized grids and between adjacent selectively energized grids; and a cathode disposed above the grids a predetermined distance apart therefrom, one of said anode groups being coated with phosphor in the form of a letter 8 and juxtaposed for displaying digits of a plurality of orders of magnitude; the other one of said anode groups being disposed apart from said one group; said grids being arranged such that they can select orders of magnitude according to the anodes of said one group, and that they divide said anode into sections to be displayed by respective anodes of said second group, said method comprising the steps of supplying a control signal to said grids at different timings for selectively displaying said letter 8 shaped anodes of said one group;

concurrently selecting corresponding anode segments for dynamically driving the same;

selecting an anode of the other group to be displayed and simultaneously supplying a control signal to all grids disposed above said selected anode for driving said grids.

* * * * *

UNITED STATES PATENT AND TRADEMARK OFFICE

CERTIFICATE OF CORRECTION

PATENT NO. : 4,401,982

DATED : August 30, 1983

INVENTOR(S) : Miyazaki, et al.

It is certified that error appears in the above-identified patent and that said Letters Patent is hereby corrected as shown below:

| COLUMN | LINE | |
|---|---|---|
| 1 | 34 | Please delete "to cover" and insert in lieu thereof --covering--. |

Signed and Sealed this

*Thirty-first* Day of *December 1985*

[SEAL]

*Attest:*

DONALD J. QUIGG

*Attesting Officer*

*Commissioner of Patents and Trademarks*